US009442417B2

(12) United States Patent
Sunahara et al.

(10) Patent No.: US 9,442,417 B2
(45) Date of Patent: Sep. 13, 2016

(54) DEVELOPING DEVICE, DEVELOPER REGULATING PROCESS, AND IMAGE FORMING DEVICE

(71) Applicant: CANON KABUSHIKI KAISHA, Tokyo (JP)

(72) Inventors: Satoshi Sunahara, Hachioji (JP); Ryosuke Kanai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/719,164

(22) Filed: May 21, 2015

(65) Prior Publication Data

US 2015/0338770 A1 Nov. 26, 2015

(30) Foreign Application Priority Data

May 26, 2014 (JP) ..... 2014-108611

(51) Int. Cl.
*G03G 15/09* (2006.01)
*G03G 15/08* (2006.01)

(52) U.S. Cl.
CPC ..... *G03G 15/0812* (2013.01); *G03G 15/08* (2013.01); *G03G 15/081* (2013.01); *G03G 15/0898* (2013.01)

(58) Field of Classification Search
CPC ..... G03G 15/0812; G03G 15/081; G03G 15/0898; G03G 15/08
USPC ..... 399/274
See application file for complete search history.

(56) References Cited

U.S. PATENT DOCUMENTS 6,356,730 B1 * 3/2002 Nonaka ..... G03G 15/0812 15/256.5
2003/0123899 A1 * 7/2003 Kamimura ..... G03G 15/0817 399/103
2011/0142500 A1 * 6/2011 Sato ..... G03G 15/0812 399/274

FOREIGN PATENT DOCUMENTS

JP 2003-195628 A 7/2003

* cited by examiner

*Primary Examiner* — Billy Lactaoen
(74) *Attorney, Agent, or Firm* — Canon USA, Inc., IP Division

(57) ABSTRACT

A developing device includes a developer bearing member that bears a developer, a developer regulating member having a regulation portion comprised of an elastic member contacting the developer bearing member, and a supporting portion supporting the regulation portion, a longitudinal direction of the regulation portion being along that of the developer bearing member, the regulation portion having a base portion and tip portion, the base portion being an end portion on a side of a portion connected with the supporting portion in a transverse direction, the base portion being opposite to the tip portion, the tip portion being disposed on an upstream side in a moving direction of the developer bearing member, the developer regulating member regulating a developer on the developer bearing member, and a sealing member contacting a regulation portion's surface, the surface being on an opposite side of the regulation portion to the developer bearing member.

13 Claims, 10 Drawing Sheets

DEVELOPING DEVICE, DEVELOPER REGULATING PROCESS, AND IMAGE FORMING DEVICE

BACKGROUND

1. Field of the Invention

The present disclosure relates to a developing device, a process cartridge, and an image forming device, the developing device and the process cartridge being used for an image forming device such as a copy machine, a printer, and a facsimile device that uses an electrophotographic system or an electrostatic recording system.

2. Description of the Related Art

Conventionally, in an image forming device using, for example, an electrophotographic system, a developing device that develops using a developer an electrostatic latent image formed on an electrophotographic photosensitive member (photosensitive member) that is an image bearing member is used. The developing device bears a developer on a developer bearing member and conveys the developer. A developer regulating member regulates and charges the developer on the developer bearing member so as to supply the developer to the electrostatic latent image on the photosensitive member opposite to the developer bearing member.

To regulate and charge the developer on the developer bearing member, a method for bringing an elastic member generally formed in a blade shape as a developer regulating member into contact with the developer bearing member is widely used.

Japanese Patent Application Laid-Open No. 2003-195628 discusses a structure in which a shape of a tip portion on a free end side of a developer regulating member in each end portion in a longitudinal direction of the developer regulating member differs from that in a center portion in the longitudinal direction of the developer regulating member so that an amount of developer at each end portion in a longitudinal direction of the developer bearing member differs from that at a center portion in the longitudinal direction of the developer bearing member.

Generally, a roller-shaped (or sleeve shape) developer bearing member is disposed such that a part in a circumferential direction of the developer bearing member is exposed from an opening portion of a container that contains the developer of the developing device. Thus, the developing device has end sealing members that are brought into contact with the part in the circumferential direction of the developer bearing member so as to prevent toner from leaking from the end portions in the longitudinal direction of the developer bearing member. When the developer regulating member comes into contact with the developer bearing member, it is effective to surround the end portions in the longitudinal direction of the developer regulating member with the end sealing members and the developer bearing member so as to prevent toner from leaking from the end portions in the longitudinal direction of the developer regulating member.

However, the inventors of the present invention know that the degree of adhesion between the developer regulating member and the developer bearing member may degrade at a portion where the end sealing members and the developer regulating member overlap depending on a shape of the developer regulating member. In particular, as will be described in detail below, when image quality is secured, a sufficient space is formed for a developer circulated between a predetermined region on the free end side of the developer regulating member and the developer bearing member. In this situation, the inventors know that the degree of adhesion tends to degrade. When the degree of adhesion between the developer regulating member and the developer bearing member degrades, it is likely that the developer enters into a portion between the region of the developer regulating member and the developer bearing member. The developer is likely to leak from the end portions in the longitudinal direction of the developer bearing member.

Thus, the developer has to be prevented from leaking.

SUMMARY OF THE INVENTION

A typical structure discussed in the present patent application includes a developer bearing member configured to bear a developer, a developer regulating member configured to have a regulation portion comprised of an elastic member that is brought into contact with the developer bearing member, and a supporting portion that supports the regulation portion, a longitudinal direction of the regulation portion being along a longitudinal direction of the developer bearing member, the regulation portion having a base portion and a tip portion, the base portion being an end portion on a side of a portion connected with the supporting portion in a transverse direction, the base portion being opposite to the tip portion, the tip portion being disposed on an upstream side in a moving direction of the developer bearing member, the developer regulating member regulating a developer borne by the developer bearing member, and a sealing member configured to be brought into contact with a surface of the regulation portion, the surface being on an opposite side of the regulation portion to the developer bearing member, wherein the regulation portion has a first region and a second region, the second region being adjacent to the first region on a side of an end portion in the longitudinal direction of the regulation portion, wherein a thickness of the escaped portion is smaller than a thickness of the contact portion so that at least a part of a region from the tip portion to the contact portion that is brought into contact with the developer bearing member escapes on a side opposite to the developer bearing member in the first region of the regulation portion, wherein a thickness of the region from the tip portion to the contact portion that is brought into contact with the developer bearing member is nearly the same in the second region of the regulation portion, and wherein the sealing member is brought into contact with only the second region of the regulation portion rather than the first region.

Further features of the present invention will become apparent from the following description of exemplary embodiments with reference to the attached drawings.

DESCRIPTION OF THE EMBODIMENTS

Next, with reference to the attached drawings, a developing device, a process cartridge, and an image forming device according to the present disclosure will be described.

1. Overall Structure and Operation of Image Forming Device

Figure 1:
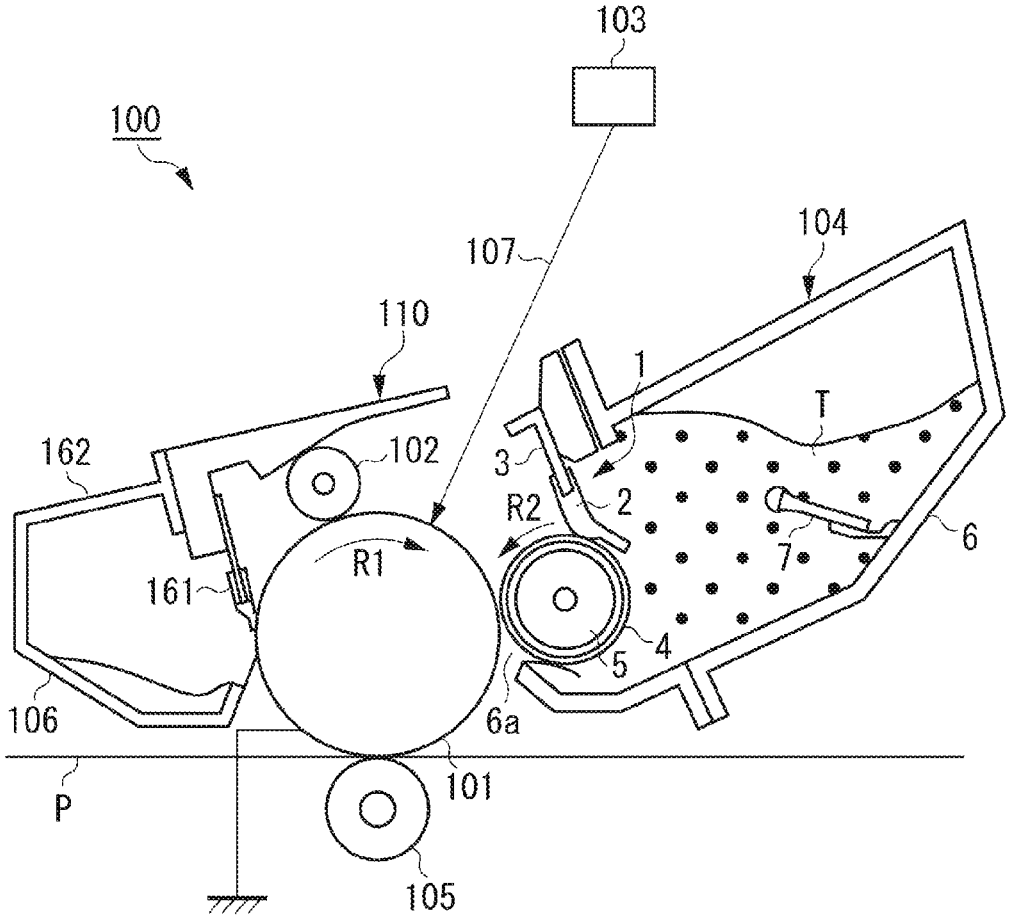
FIG. 1 is a schematic diagram illustrating an outline of principal portions of an image forming device.

First, the overall structure and operation of the image forming device according to a first exemplary embodiment will be described. FIG. 1 is a schematic sectional view illustrating principal portions of an image forming device 100 according to the present exemplary embodiment. The image forming device according to the present exemplary embodiment is a process-cartridge type laser-beam printer using an electrophotographic system.

The process cartridge generally contains an electrophotographic photosensitive member (photosensitive member) and process means that acts on the photosensitive member. The process cartridge is detachable from a device main body of the electrophotographic image forming device. For example, the cartridge contains a photosensitive member and at least one of developing means, which is process means, charging means, and cleaning means. The process cartridge contains at least a developer bearing member and a developer regulating member that compose developing means. In addition, the electrophotographic image forming device forms an image on a recording medium using an electrophotographic image forming system. The electrophotographic image forming device includes for example an electrophotographic copying machine, an electrophotographic printer (light-emitting diode (LED) printer, laser beam printer, and so forth), a facsimile device, and a word processor. The device main body of the image forming device is a portion in which the process cartridge is removed from the image forming device.

The image forming device 100 has a photosensitive drum 101 that is a drum type (cylindrical) rotatable photosensitive member serving as an image bearing member. The photosensitive drum 101 is driven to rotate in an arrow R1 direction (clockwise) illustrated in the figure. A front surface of the rotatable photosensitive drum 101 is equally charged by a charging roller 102 that is a roller-shaped charging member serving as charging means. The front surface of the photosensitive drum 101 that has been charged is irradiated with a laser beam 107 corresponding to image information by an exposing device (laser scanner device) 103 serving as exposing means. As a result, an electrostatic latent image (electrostatic image) corresponding to the image information is formed on the photosensitive drum 101. The electrostatic latent image formed on the photosensitive drum 101 is developed (visualized) as a toner image using toner as a developer by a developing device 104 including developing means. The toner image formed on the photosensitive drum 101 is transferred onto a recording material P such as recording paper by a transfer roller 105 that is a roller-shaped transferring member serving as transferring means. The recording material P on which the toner image has been transferred is heated and pressurized by a fixing device serving as fixing means (not illustrated). As a result, the toner image is fixed on the recording material P. Toner that remains on the photosensitive drum 101 after the transferring step (residual transfer toner) is removed from the photosensitive drum 101 and collected by a cleaning device 106 including cleaning means.

The developing device 104 includes a developing sleeve 4 serving as a developer bearing member that bears and conveys a toner T. The developing sleeve 4 is disposed opposite the photosensitive drum 101. The developing sleeve 4 is rotatably supported by a container (developing container) 6 of the developing device 104. The developing container 6 contains the toner T. The developing sleeve 4 is driven to rotate in an arrow R2 direction illustrated in the figure (counterclockwise). A magnet roller 5 that is magnetic field generating means is disposed in a hollow portion of the developing sleeve 4. The magnet roller 5 is fixed in a predetermined posture while the developing device 104 is being operated. The developing sleeve 4 is disposed such that a part in a circumferential direction of the developing sleeve 4 is exposed from an opening portion **6*a* opposite to the photosensitive drum 101 of the developing container 6. In addition, the developing device 104 includes a developing blade 1 that is a developer regulating member that regulates both an amount of toner borne by the developing sleeve 4 and a charging state. The developing blade 1 is elastically deformed by the developing sleeve 4 so that the developing blade 1 is brought into contact with the developing sleeve 4. The developing device 104 includes an agitating and conveying member 7 that agitates the toner T contained in the developing container 6 and conveys the toner T toward the developing sleeve 4. In the developing device 104, the developing blade 1 regulates and frictionally charges the toner T borne on the developing sleeve 4 by magnetic force of the magnet roller 5 as the developing sleeve 4 is rotated. In addition, the developing device 104 conveys the toner T to a region opposite to the photosensitive drum 101 (developing region). The conveyed toner T is supplied onto the photosensitive drum 101 corresponding to the electrostatic latent image on the photosensitive drum 101. As a result, the toner image is formed on the photosensitive drum 101. According to the present exemplary embodiment, the developing sleeve 4, the magnet roller 5, the developing blade 1, and so forth compose the developing means. According to the present exemplary embodiment, the developer is a negatively charged magnetic one-component developer having a main component of negatively chargeable acrylic styrene and containing a magnetic material (hereinafter this developer is also simply referred to as toner). The developing sleeve 4 is composed of an aluminum bare tube that contains the magnet roller 5 and that is coated with a resin. The developing blade 1** will be described below in detail.

The cleaning device 106 includes a cleaning blade 161 and a waste toner container 162 that are cleaning means. The residual transfer toner on the rotatable photosensitive drum 101 is scratched by the cleaning blade 161 that is brought into contact with the photosensitive drum 101. The scratched waste toner is collected to the waste toner container 162.

According to the present exemplary embodiment, the photosensitive drum 101, the charging roller 102, the developing device 104, and the cleaning device 106 are unified as a cartridge. As a result, the process cartridge 110 that is detachable from the device main body of the image forming device 100 is formed.

2. Developing Blade

Figure 2:
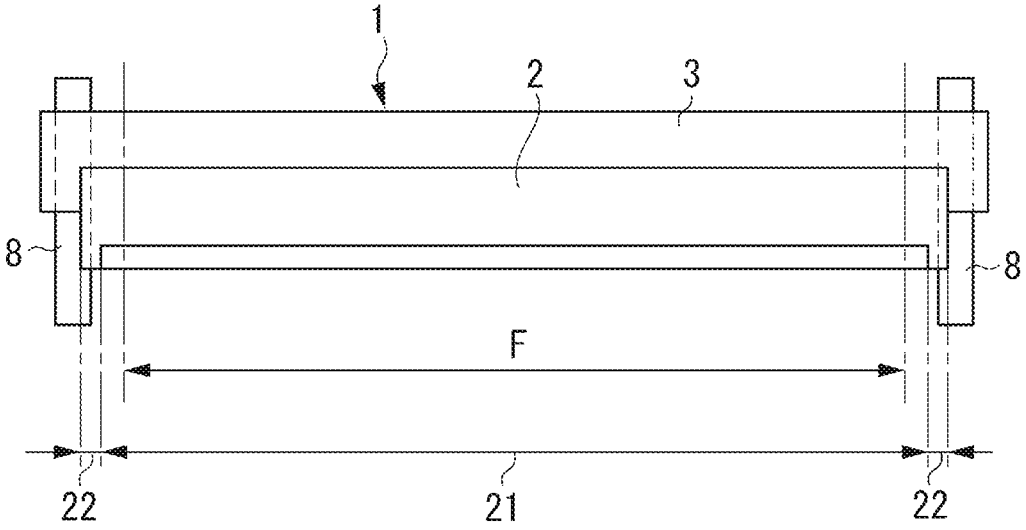
FIG. 2 is a side view of a developing blade seen from a side of a developing sleeve.
Figure 3A:
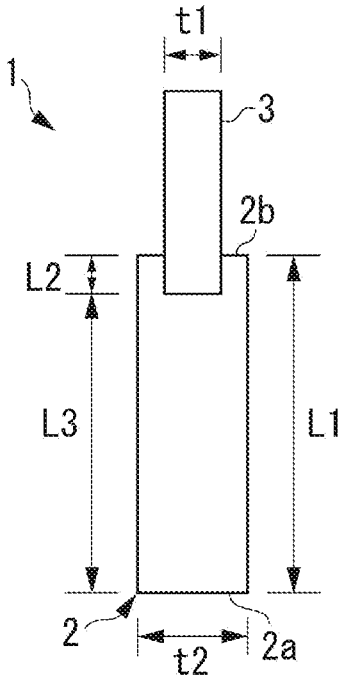
FIGS. 3A and 3B are sectional views illustrating an end portion and a center portion in a longitudinal direction of the developing blade that is not brought into contact with the developing sleeve, respectively.
Figure 3B:
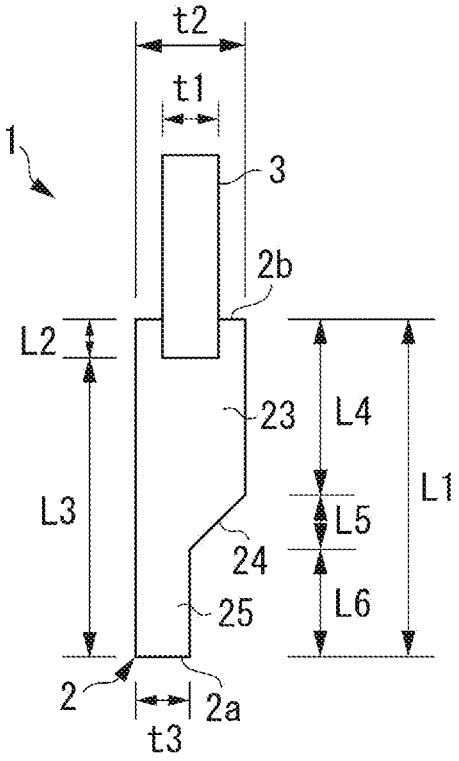
Figure 4A:
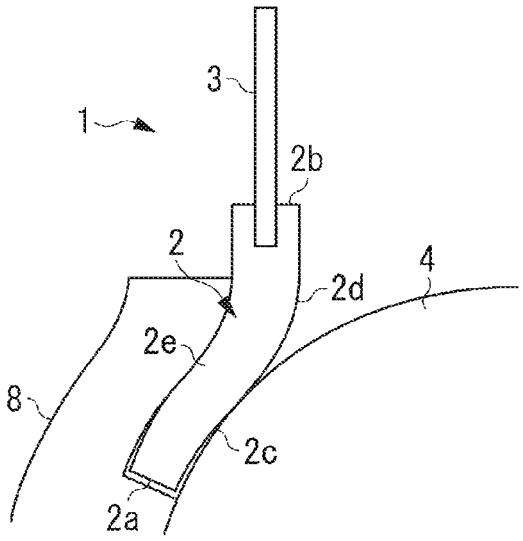
FIGS. 4A and 4B are sectional views illustrating the end portion and the center portion in the longitudinal direction of the developing blade that is brought into contact with the developing sleeve, respectively.
Figure 4B:
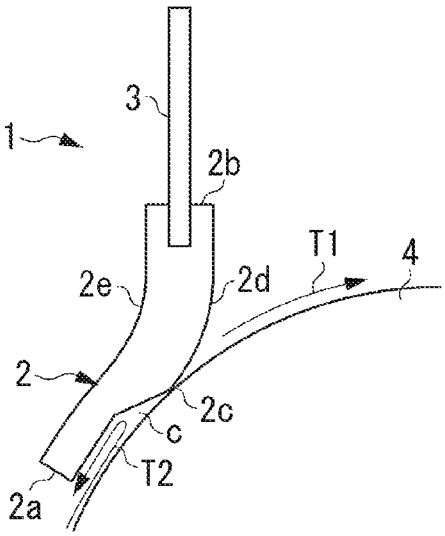

Next, the developing blade 1 that is a developer regulating member according to the present exemplary embodiment will be described. FIG. 2 is a side view of the developing blade 1 seen from a side of the developing sleeve 4. FIGS. 3A and 3B are sectional views in a direction perpendicular to a longitudinal direction of the developing blade 1 that is not brought into contact with the developing sleeve 4 (the regulation portion that will be described below has not been elastically deformed). FIGS. 4A and 4B are sectional views seen in the direction perpendicular to the longitudinal direction of the developing blade 1 that is brought into contact with the developing sleeve 4 (the regulation portion has been elastically deformed). FIGS. 3A and 4A are sectional views of an end portion in the longitudinal direction of the developing blade 1. FIGS. 3B and 4B are sectional views of a center portion in the longitudinal direction of the developing blade 1.

The developing blade 1 that regulates toner borne by the developing sleeve 4 has a regulation portion 2 that is composed of an elastic member brought into contact with the developing sleeve 4 and a supporting portion 3 that supports the regulation portion 2. The developing blade 1 is disposed such that a longitudinal direction of the regulation portion 2 is along that of the developing sleeve (in a direction of a rotation axis of the developing sleeve 4). In the developing blade 1, a tip portion 2*a* that is an end portion opposite to a base portion 2*b* that is an end portion on a side of a portion connected with the supporting portion 3 in a transverse direction of the regulation portion 2, is disposed on an upstream side of a moving direction of the front surface of the developing sleeve 4 (counter contact).

As illustrated in FIG. 2, the regulation portion 2 of the developing blade 1 includes a first region 21 and two second regions 22. The first region 21 is disposed at a center portion in the longitudinal direction of the developing blade 1. The second regions 22 are disposed on sides of both ends of the developing blade 1 such that the second regions 22 sandwich the first region 21. As illustrated in FIG. 3B, in the first region 21, a thickness of at least a part of a region from the tip portion 2*a* to a contact portion 2*c* that is brought into contact with the developing sleeve 4 is smaller than a thickness of the contact portion 2*c* such that the region escapes on an opposite side of the developing sleeve 4. On the other hand, as illustrated in FIG. 3A, in the second regions 22, the thickness of the region from the tip portion 2*a* to the contact portion 2*c* that is brought into contact with the developing sleeve 4 is nearly the same.

In the first region 21, it is desirable for the regulation portion 2 to be brought into contact with the developing sleeve 4 near a boundary between the portion having the thickness of the contact portion 2*c* and a portion having the thickness smaller than the contact portion 2*c*. As a result, a sufficient effect of circulating the developer (that will be described below) can be obtained at a close position where the regulation portion 2 regulates the developer. According to the present exemplary embodiment, in the first region 21, the regulation portion 2 is brought into contact with the developing sleeve 4 at the boundary. However, the boundary may be disposed on an upstream side of the contact portion 2*c* in the moving direction of the front surface of the developing sleeve 4. In particular, according to the present exemplary embodiment, in the first region 21 of the regulation portion 2, the thickness of a part of the region from the contact portion 2*c* to the tip portion 2*a* of the regulation portion 2 gradually decreases on a side of the tip portion 2*a* as a tapered portion such that the region escapes on the opposite side of the developing sleeve 4. In addition, the thickness of a portion extending from the tapered portion to the tip portion 2*a* is nearly the same. The tapered portion allows the developer to smoothly move near the contacting region between the developing blade 1 and the developing sleeve 4. As a result, the sufficient effect of circulating the developer can be more easily obtained. When a portion that extends from the tapered portion to the tip portion and that has a constant thickness is disposed on the developing blade 1, a space in which the developer stays and circulates tends to occur between the developing blade 1 and the developing sleeve 4. The second regions 22 of the regulation portion 2 are disposed in the longitudinal direction of the developing sleeve 4 and outside a region F corresponding to the image forming region on the photosensitive drum 101 serving as the image bearing member (in this example, this region is also conveniently referred to as an "image forming region"). The image forming region on an image bearing member is a region in which an electrostatic latent image for an image that is transferred to the recording material and is output from the image forming device can be formed.

Next, the structure of the regulation portion 2 will be described in more detail. According to the present exemplary embodiment, a thickness of a protruding portion that protrudes on an upstream side in the moving direction of the front surface of the developing sleeve 4 from a contacting region of the developing blade 1 that is brought into contact with the developing sleeve 4 at the center portion in the longitudinal direction of the developing blade 1 is different from that at each of the end portions in the longitudinal direction of the developing blade 1. In other words, in the first region 21, which is the center portion in the longitudinal direction of the regulation portion 2, the regulation portion 2 includes a thick wall portion 23, a slope portion 24, and a thin wall portion 25 seamlessly in order in the direction from the base portion 2*b* to the tip portion 2*a*. The thick wall portion 23 from the base portion 2*b* to the contact portion 2*c* that is brought into contact with the developing sleeve 4 has nearly the same thickness. The slope portion 24 that is a part from the contact portion 2*c* to the tip portion 2*a* has a thickness that gradually decreases on a side of a contact surface 2*d* facing the developing sleeve 4. As a result, the thickness of the slope portion 24 decreases gradually as a tapered portion. The thin wall portion 25 from the slope portion 24 to the tip portion 2*a* has nearly the same thickness that is smaller than that of the thick wall portion 23. In contrast, in the second regions 22, which are the end portions in the longitudinal direction of the regulation portion 2, the thickness of the regulation portion 2 is nearly the same from the contact portion 2*c* to the tip portion 2*a* (according to the present exemplary embodiment, in the entire regulation portion 2 from the base portion 2*b* to the tip portion 2*a*). According to the present exemplary embodiment, the boundary between the thick wall portion 23 and the slope portion 24 on the contact surface 2*d* becomes the contact portion 2*c* that extends in the longitudinal direction of the developing sleeve 4. In this description, the nearly the same thickness means that the thickness may be able to contain errors that are considered functionally equivalent, for example errors of about ±30%.

With reference to FIGS. 3A and 3B, according to the present exemplary embodiment, the supporting portion 3 is made of a steel use stainless (SUS) 304 metal plate (support metal plate) having a thickness t1 of 1.2 mm. The regulation portion 2 made of urethane rubber that is an example of a rubber material that is an elastic member is integrally formed at an end portion of the supporting portion 3. In the second regions 22 (refer to FIG. 3A), which are the end portions in the longitudinal direction of the regulation portion 2, a thickness t2 of the regulation portion 2 is nearly constant, 1.8 mm. In contrast, in the first region 21, which is the center portion in the longitudinal direction of the regulation portion 2, the thickness t2 of the thick wall portion 23 is 1.8 mm. The thickness of the slope portion 24 gradually decreases to 0.8 mm on the side of the tip portion 2*a*. A thickness t3 of the thin wall portion 25 is nearly constant, 0.8 mm.

According to the present exemplary embodiment, in each of the first region 21 and the second regions 22 of the regulation portion 2, a full length L1 of the regulation portion 2 from the base portion 2*b* to the tip portion 2*a* is 4.0 mm, where a fixed length L2 is 0.5 mm, and a free length L3 is 3.5 mm. In the first region 21 of the regulation portion 2, a length L4 of the thick wall portion 23 is 2.0 mm, a length L5 of the slope portion 24 is 0.5 mm, and a length L6 of the thin wall portion 25 is 1.5 mm.

When the sizes of the foregoing portions of the developing blade 1 are adequately set, the sufficient effect of circulating the developer can be obtained. Typically, the sizes of these portions of the developing blade 1 are set as follows to obtain a good result. The thickness of the thin wall portion 25 is desirably not more than the half of the thickness of the thick wall portion 23. Normally, the thickness of the thin wall portion 25 is approximately 0.5 mm or greater. The length of the thin wall portion 25 in the transverse direction of the developing blade 1 is desirably equal to or greater than the thickness of the thin wall portion 25. When the thickness of the thin wall portion 25 in the transverse direction of the developing blade 1 is equal to or less than the thickness of the thick wall portion 23, the effect of circulating the developer may be sufficiently improved. When the slope portion 24 is provided, the length of the slope portion 24 in the transverse direction of the developing blade 1 is desirably equal to or less than the thickness of the thin wall portion 25.

As illustrated in FIG. 2, the developing device 104 includes end sealing members 8 that are brought into contact with a part in the circumferential direction of the developing sleeve 4. The end sealing members 8 prevent toner from leaking from the end portions in the longitudinal direction of the developing sleeve 4. The developing blade 1 and the end sealing members 8 are disposed in the longitudinal direction as illustrated in FIG. 2. In other words, the end sealing members 8 are disposed at both the end portions in the longitudinal direction of the developing sleeve 4 and outside the image forming region F. In the longitudinal direction of the developing sleeve 4, both the end portions in the longitudinal direction of the developing blade 1 overlap with the end sealing members 8. Each of the end portions in the longitudinal direction of the developing blade 1 is disposed between a part of the end sealing member 8 and the developing sleeve 4. As a result, toner is prevented from leaking from the end portions in the longitudinal direction of the developing blade 1. According to the present exemplary embodiment, as the end sealing members 8, felt seals having a fluff portion that is brought into contact with the developing sleeve 4 are used. The end sealing members 8 press the regulation portion 2 of the developing blade 1 at the end portions in the longitudinal direction of the developing sleeve 4 so as to fill up the space between the regulation portion 2 and the developing sleeve 4 with the end sealing members 8. Thus, toner is unlikely to leak from the end portions in the longitudinal direction of the developing sleeve 4. According to the present exemplary embodiment, the end sealing members 8 are brought into contact with a surface of the regulation portion 2, the surface being on an opposite side of the regulation portion 2 to the developing sleeve 4. In addition, the end sealing members 8 are brought into contact with the end surface of the tip portion 2*a* of the regulation portion 2 and the developing sleeve 4.

Thus, according to the present exemplary embodiment, the developing device 104 includes the end sealing members 8 at the end portions in the longitudinal direction of the regulation portion 2. In at least a part of a region extending from the tip portion 2*a* to the base portion 2*b* of the regulation portion 2, the end sealing members 8 are brought into contact with a surface of the regulation portion 2, the surface being on an opposite side of the regulation portion 2 to the developing sleeve 4 (non-contact surface) 2*e*. The end sealing members 8 are brought into contact with the surface of the regulation portion 2 only in the second regions 22 in the longitudinal direction of the regulation portion 2 rather than the first region 21.

According to the present exemplary embodiment, the end sealing members 8 overlap with the developing blade 1 in the longitudinal direction of the developing sleeve 4. However, if the end sealing members 8 do not overlap with the developing blade 1 unlike the present exemplary embodiment, toner that is not regulated by both the end sealing members 8 and the developing blade 1 is likely to occur on the developing sleeve 4 because of the sizes and assembling tolerances of these parts. In addition, the bearing amount of toner is likely to increase because of powder pressure. In all these cases, toner is more likely to leak. Thus, the end sealing members 8 desirably overlap with the developing blade 1.

3. Circulation of Toner Near Developing Blade

Next, circulation of toner near the developing blade 1 according to the present exemplary embodiment will be described.

As illustrated in FIG. 4B, toner moves at the center portion in the longitudinal direction of the developing blade 1. In other words, as the developing sleeve 4 rotates, toner is conveyed near the contacting region between the developing blade 1 and the developing sleeve 4. Part of the toner is brought in the contacting region between the developing blade 1 and the developing sleeve 4. The toner is frictionally charged by the developing blade 1. The toner is conveyed to a developing region as represented by an arrow T1 illustrated in the figure. The toner is used for development. On the other hand, toner that is not brought in the contacting region between the developing blade 1 and the developing sleeve 4 is scratched away by the developing blade 1 as represented by an arrow T2 illustrated in the drawing. At this point, according to the present exemplary embodiment, since the regulation portion 2 of the developing blade 1 has the foregoing shape, a sufficient space (circulation region C) in which toner is circulated is formed between a region near the contact portion 2*c* on the side of the tip portion 2*a* of the regulation portion 2 and the developing sleeve 4. In other words, the toner that does not contribute to development is not immediately returned to the developing container 6 by the developing blade 1. Instead, the toner tends to stay in the circulation region C and circulate. Thus, when an image having a high printing ratio is printed, new toner that is not sufficiently frictionally charged is hard to be brought in the contacting region. As a result, the ratio of toner newly supplied to the developing region in the case that an image having a high printing ratio is printed does not differ from that in the case that an image having a low printing ratio is printed. As a result, chargeability of toner used for development is stable.

On the other hand, toner moves at the end portions in the longitudinal direction of the developing blade 1 as illustrated in FIG. 4A. In other words, at the end portions in the longitudinal direction of the developing blade 1, the end sealing members 8 press the developing blade 1 so that the regulation portion 2 is deformed corresponding to the developing sleeve 4. Thus, a space is hard to be formed between the developing blade 1 and the developing sleeve 4. As a result, an amount of toner in the region can be decreased in comparison with that at the center portion in the longitudinal direction of the developing blade 1. Consequently, the end sealing members 8 can easily suppress leakage of toner at the end portions in the longitudinal direction of the developing blade 1. In addition, since this region is outside the image forming region (a margin of the recording material P or outside the recording material), the necessity for circulation of toner near the developing blade 1 is low. Thus, problems about images are unlikely to occur.

Next, effects of the present exemplary embodiment and comparative examples will be described in detail. For simplicity, in the comparative examples, elements having the same functions and/or structures as the present exemplary embodiment are represented by the same signs and redundant description thereof will be avoided.

Figure 5:
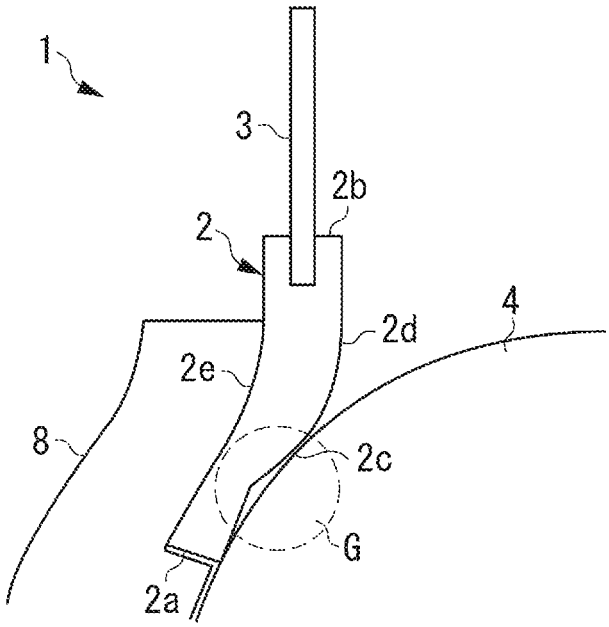
FIG. 5 is a sectional view illustrating an end portion in a longitudinal direction of a developing blade according to a comparative example.

According to a first comparative example, a shape of a regulation portion 2 at a center portion in a longitudinal direction of a developing blade 1 is the same as that at each of end portions in the longitudinal direction of the developing blade 1. The shape of the regulation portion 2 according to the first comparative example is the same as the shape of the regulation portion in the first region 21 of the developing blade 1 according to the first exemplary embodiment (however, according to the first comparative example, the thickness of a part on the side of the tip portion 2*a* is smaller than the thickness of the rest on the side of the tip portion 2*a*). In other words, according to the first comparative example, the regulation portion 2 has the cross section illustrated in FIG. 3B, at each of the center portion and the end portions in the longitudinal direction of the developing blade 1. In this case, at each of the end portions in the longitudinal direction of the developing sleeve 4, the developing blade 1 is brought into contact with the developing sleeve 4 as illustrated in FIG. 5. At the center portion in the longitudinal direction of the developing sleeve 4, the developing blade 1 is brought into contact with the developing sleeve 4 in the same manner as the present exemplary embodiment illustrated in FIG. 4B.

Figure 6:
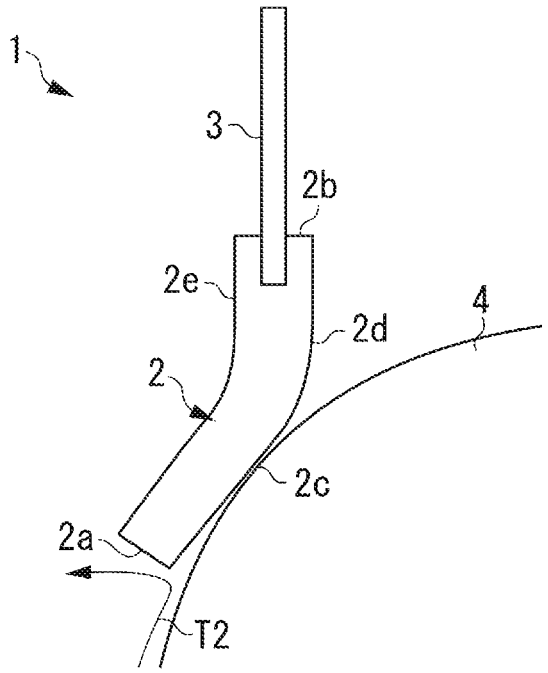
FIG. 6 is a sectional view illustrating a center portion in a longitudinal direction of a developing blade according to the comparative example.

According to a second comparative example, a shape of a regulation portion 2 at a center portion in a longitudinal direction of a developing blade 1 is the same as that at each of end portions in the longitudinal direction of the developing blade 1. The shape of the regulation portion 2 according to the second comparative example is the same as the shape of the regulation portion 2 in each of the second regions 22 of the developing blade according to the first exemplary embodiment (however, according to the second comparative example, the thickness of a part on the side of the tip portion 2*a* is nearly constant). In other words, according to the second comparative example, the regulation portion 2 has the cross section illustrated in FIG. 3A, at each of the center portion and the end portions in the longitudinal direction of the developing blade 1. In this case, at each of the end portions in the longitudinal direction of the developing sleeve 4, the developing blade 1 is brought into contact with the developing sleeve 4 as illustrated in FIG. 6. At each of the end portions in the longitudinal direction of the developing sleeve 4, the developing blade 1 is brought into contact with the developing sleeve 4 in the same manner as the present exemplary embodiment illustrated in FIG. 4A.

As described above, according to the first comparative example, at each of the end portions in the longitudinal direction of the developing sleeve 4, the developing blade 1 is brought into contact with the developing sleeve 4 as illustrated in FIG. 5. At this point, a thickness of a region near a contact portion 2*c* that is brought into contact with the developing sleeve 4 on the side of the tip portion 2*a* of the regulation portion 2 gradually decreases. Thus, since the tip portion 2*a* of the regulation portion 2 is pressed by the end sealing members 8, the tip portion 2*a* is elastically deformed. As a result, the regulation portion 2 is brought into contact with the developing sleeve 4. However, even if the rear surface (non-contact surface) 2*e* of the regulation portion 2 is pressed by the end sealing members 8, in the region having a small thickness between the tip portion 2*a* and the contact portion 2*c* of the regulation portion 2, it is hard that the regulation portion 2 is brought into close contact with the developing sleeve 4. Thus, a space G may occur between the regulation portion 2 and the developing sleeve 4 in the region between the tip portion 2*a* and the contact portion 2*c* of the regulation portion 2. As a result, toner tends to enter into the space G laterally in the longitudinal direction of the developing sleeve 4. Consequently, toner tends to leak, through the space G, from the end portions in the longitudinal direction of the developing sleeve 4 in such a way that toner slips through the end sealing members 8. Thus, according to the first comparative example, the sealing property of toner at the end portions in the longitudinal direction of the developing sleeve 4 tends to lower. In contrast, according to the present exemplary embodiment, as described above, the sealing property of toner at the end portions in the longitudinal direction of the developing sleeve 4 can be adequately secured. Movement of toner near the developing blade 1 at the center portion in the longitudinal direction of the developing sleeve 4 according to the first comparative example is the same as that according to the present exemplary embodiment.

In addition, as described above, according to the second comparative example, at the center portion in the longitudinal direction of the developing sleeve 4, the developing blade 1 is brought into contact with the developing sleeve 4 as illustrated in FIG. 6. At this point, unlike the present exemplary embodiment illustrated in FIG. 4B, a sufficient space in which toner is circulated is not formed between a region near the contact portion 2*c* on the side of the tip portion 2*a* of the regulation portion 2 and the developing sleeve 4. In other words, toner that does not contribute to development tends to be immediately returned to the developing container 6. Thus, when an image having a high printing ratio is printed, newly supplied toner that is not sufficiently frictionally charged tends to be brought in the contacting region. As a result, since the ratio of toner that is newly supplied in the developing region in the case that an image having a high printing ratio is printed largely differs from that in the case that an image having a low printing ratio is printed. Thus, chargeability of toner supplied for development tends not to be stable. In contrast, according to the present exemplary embodiment, since circulation of toner in the circulation region C is facilitated, the chargeability of toner used for development can be stable. Movement of toner near the developing blade 1 at each of the end portions in the longitudinal direction of the developing sleeve 4 according to the second comparative example is the same as that according to the present exemplary embodiment.

According to the present exemplary embodiment, the first comparative example, and the second comparative example, images were evaluated based on occurrence of sleeve ghost patterns. Stains at each of the end portions in the longitudinal direction of the developing device 104 were observed so as to determine whether toner leakage had occurred at each of the end portions in the longitudinal direction of the developing sleeve 4. The results are listed in Table 1. The sleeve ghosts are a phenomenon in which a shape of a toner image formed in a first turn of the developing sleeve 4 appears in a second turn of the developing sleeve 4. When newly supplied toner that has not been sufficiently charged increases on the developing sleeve 4, only a portion in which toner is largely consumed in the first turn of the developing sleeve 4 becomes dark. In Table 1, sign 0 denotes that the image density level is acceptable, whereas sign x denotes that the image density level is not acceptable.

TABLE 1

| | Sleeve ghost | Toner leakage |
|---|---|---|
| First exemplary embodiment | ○ | ○ |
| First comparative example | ○ | x |
| Second comparative example | x | ○ |

As is clear from Table 1, the developing device 104 according to the present exemplary embodiment is superior to those of the first and second comparative examples in both image quality and user friendliness.

Thus, according to the present exemplary embodiment, at the center portion in the longitudinal direction of the developing sleeve 4, toner can be circulated in the circulation region C surrounded by the region having the small thickness on the side of the tip portion 2*a* of the regulation portion 2 of the developing blade 1 and the developing sleeve 4. Thus, an influence of toner that is consumed on the developing sleeve 4 and that is newly supplied to the developing sleeve 4 can be decreased. As a result, toner can be more stably charged. As a result, while image quality is stabilized, sealing property of toner is securely improved at each of the end portions in the longitudinal direction of the developing sleeve 4. Consequently, toner can be prevented from leaking. Thus, according to the present exemplary embodiment, while the shape of the developing blade 1 allows image quality to be stabilized, toner can be prevented from leaking.

Figure 7:
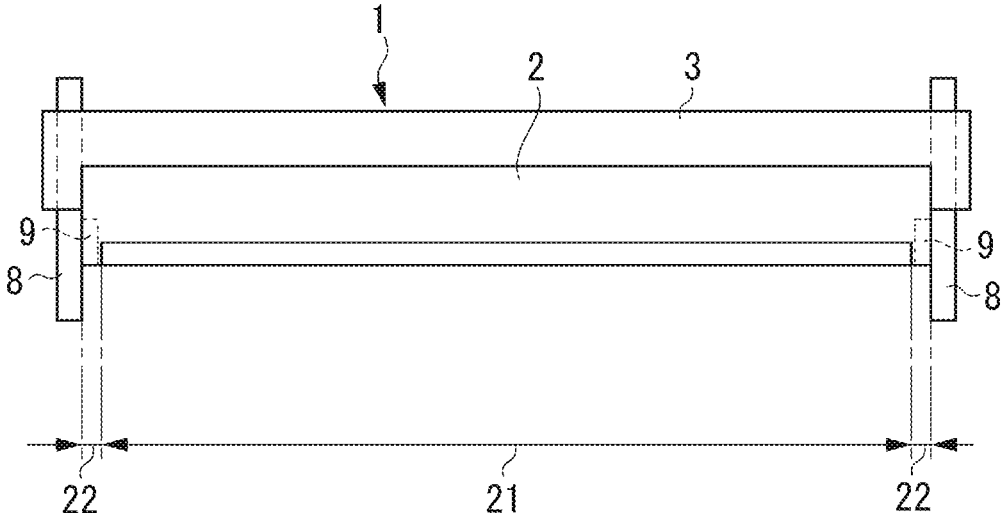
FIG. 7 is a side view of the developing blade seen from the side of the developing sleeve, side pads serving as sealing members being brought into contact with the developing blade.

According to the present exemplary embodiment, the sealing members that are brought into contact with the non-contact surface 2*e* of the regulation portion 2 of the developing blade 1 are the end sealing members 8 that are brought into contact with the end portions in the longitudinal direction of the developing sleeve 4. However, the sealing members are not limited to the end sealing members 8. For example, as illustrated in FIG. 7, the regulation portion 2 of the developing blade 1 may not overlap with the end sealing members 8. Instead, side pads 9 that are members different from the end sealing members 8 may press the end portions in the longitudinal direction of the regulation portion 2. In this case, when the sectional shape of the end portions in the longitudinal direction of the regulation portion 2 of the developing blade 1, the end portions being pressed by the side pads 9, are the same as that according to the present exemplary embodiment, good image quality can be secured and toner can be prevented from leaking like the present exemplary embodiment. The side pads 9 may be made of Moltopren or the like.

Next, another exemplary embodiment will be described. The basic structure and operation of a developing device, a process cartridge, and an image forming device according to the present exemplary embodiment are the same as those according to the first exemplary embodiment. Thus, elements having same or corresponding functions and structures as the first exemplary embodiment are represented by the same signs and redundant description thereof will be avoided.

Figure 8:
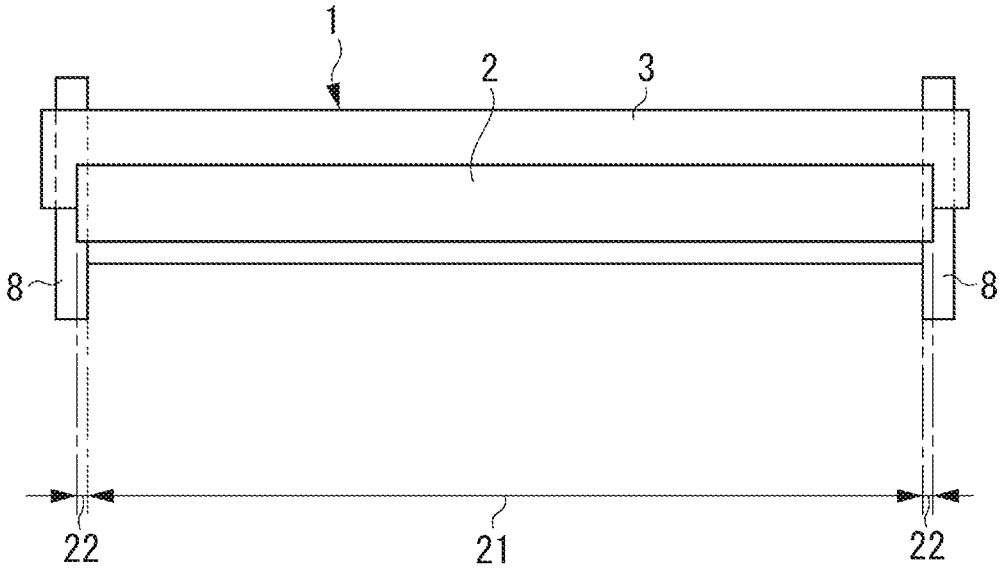
FIG. 8 is a side view of another exemplary developing blade seen from a side of a developing sleeve.
Figure 9:
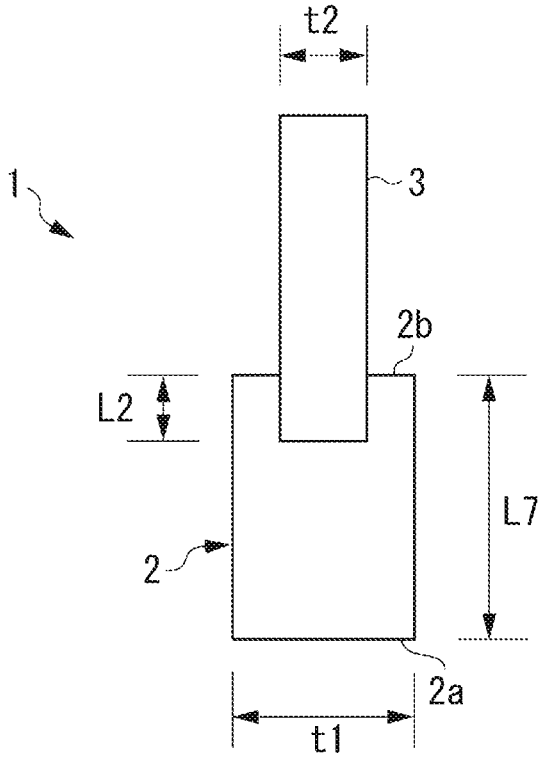
FIG. 9 is a sectional view illustrating an end portion in a longitudinal direction of another exemplary developing blade, the end portion not being brought into contact with the developing sleeve.
Figure 10:
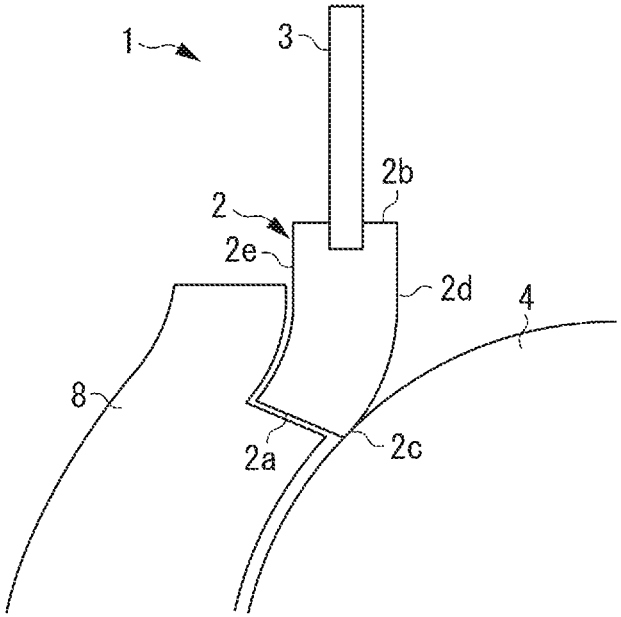
FIG. 10 is a sectional view illustrating the end portion in the longitudinal direction of the another exemplary developing blade, the end portion being brought into contact with the developing sleeve.

FIG. 8 is a side view of a developing blade 1 seen from a side of a developing sleeve 4. FIG. 9 is a sectional view of the developing blade 1 seen from a direction perpendicular to the longitudinal direction of the developing blade 1 at each of the end portions in the longitudinal direction of the developing blade 1 in the state that the developing blade 1 is not brought into contact with the developing sleeve 4 (a regulation portion is not elastically deformed). FIG. 10 is a sectional view of the developing blade 1 in the same manner as illustrated in FIG. 9 at each of the end portions in the longitudinal direction of the developing blade 1 in the state that the developing blade 1 is brought into contact with the developing sleeve 4 (the regulation portion is elastically deformed).

The shape of the regulation portion 2 of the developing blade 1 in the first region 21 according to the present exemplary embodiment is the same as that according to the first exemplary embodiment. However, according to the present exemplary embodiment, the tip portion 2*a* of the regulation portion 2 in the second regions 22 is brought into contact with the developing sleeve 4. The end sealing members 8 in the second regions 22 of the regulation portion 2 rather than the first region 21 are brought into contact with the developing sleeve 4.

Next, the structure of the regulation portion 2 will be described in more detail. According to the present exemplary embodiment, as illustrated in FIG. 8, the length from the contact portion 2*c* that is brought into contact with the developing sleeve 4 to the tip portion 2*a* in the first region 21, which is the center portion in the longitudinal direction of the regulation portion 2 of the developing blade 1, differs from that in each of the second regions 22, which are the end portions. In the first region 21, which is the center portion in the longitudinal direction of the regulation portion 2, a thin protrusion portion that protrudes from the contact portion 2*c* on a side of a free end is disposed. In contrast, in the second regions 22, which are the end portions in the longitudinal direction of the regulation portion 2, an edge of a free end of the regulation portion 2 is brought into contact with the developing sleeve 4. In other words, in the second regions 22, which are the end portions in the longitudinal direction of the regulation portion 2, the slope portion 24 and the thin wall portion 25 that are disposed from the contact portion 2*c* to the tip portion 2*a* in the first region 21, which is the center portion in the longitudinal direction of the regulation portion 2, are not disposed. In the second regions 22, which are the end portions in the longitudinal direction of the regulation portion 2 in which the end sealing members 8 overlap with the regulation portion 2 in the longitudinal direction of the developing sleeve 4, the tip portion 2*a* of the regulation portion 2 is brought into contact with the developing sleeve 4.

With reference to FIG. 9, according to the present exemplary embodiment, in the second regions 22, which are the end portions in the longitudinal direction of the regulation portion 2, a thickness t2 of the regulation portion 2 is nearly constant, 1.8 mm, whereas a full length L7 of the regulation portion 2 from the base portion 2*b* to the tip portion 2*a* is 2.0 mm. Sizes of other portions of the developing blade 1 according to the present exemplary embodiment are the same as those according to the first exemplary embodiment.

According to the present exemplary embodiment, as illustrated in FIG. 10, when the rear surface (non-contact surface) 2*e* of the regulation portion 2 is pressed by the end sealing members 8, since an edge of the free end of the regulation portion 2 is brought into contact with the developing sleeve 4, a space is hard to be formed between the regulation portion 2 and the developing sleeve 4. Thus, the sealing property of toner at each of the end portions in the longitudinal direction of the developing sleeve 4 can be adequately secured. Movement of toner near the developing blade 1 at the center portion in the longitudinal direction of the developing sleeve 4 according to the present exemplary embodiment is the same as that according to the first exemplary embodiment. Thus, like the first exemplary embodiment, the present exemplary embodiment is excellent in image quality and user friendliness.

Like the first exemplary embodiment, according to the present exemplary embodiment, while good image quality is secured, toner can be prevented from leaking.

Like the first exemplary embodiment, rather than the structure in which the end sealing members 8 overlap with the developing blade 1, a structure in which other members (sealing members) such as the side pads 9 (refer to FIG. 8) prevent toner from leaking from the end portions in the longitudinal direction of the developing blade 1 may be applied to the present exemplary embodiment. When such a structure is applied to the present exemplary embodiment, the foregoing effect can be achieved.

Others

Although the present invention has been described based on specific exemplary embodiments, the present invention is not limited to the foregoing exemplary embodiments.

The structures and materials of the foregoing exemplary embodiments are merely examples. Thus, the present invention is not limited to the foregoing exemplary embodiments.

In the foregoing exemplary embodiments, the developing device is a part of a structure of a process cartridge. However, the present invention is not limited to such a structure. For example, the developing device may be detachable from the device main body of the image forming device. Alternatively, the developing device may be a part of an image forming device such that the developing device is not easily detachable from the image forming device. In this case, a developer may be supplied from a developer bottle to the developing device.

According to the present invention, the shape of the developer regulating member allows image quality to be stabilized and prevents the developer from leaking.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-108611, filed May 26, 2014, which is hereby incorporated by reference herein in its entirety.

What is claimed is:

1. A developing device comprising:

a developer bearing member configured to bear a developer;

a developer regulating member configured to have a regulation portion comprised of an elastic member that is brought into contact with the developer bearing member, and a supporting portion that supports the regulation portion, wherein a longitudinal direction of the regulation portion is along a longitudinal direction of the developer bearing member, wherein the regulation portion has a base portion and a tip portion, wherein the base portion is an end portion on a side of a portion connected with the supporting portion in a transverse direction, and the base portion is opposite to the tip portion, wherein the tip portion is disposed on an upstream side in a moving direction of the developer bearing member, and wherein the developer regulating member regulates a developer borne by the developer bearing member; and a sealing member configured to be brought into contact with a surface of the regulation portion, wherein the surface is on an opposite side of the regulation portion to the developer bearing member, wherein the regulation portion has a first region and a second region, wherein the second region is adjacent to the first region on a side of an end portion in the longitudinal direction of the regulation portion, and the second region is disposed outside a region corresponding to an image forming region on an image bearing member on which an electrostatic image to be developed by the developing device is formed, in a longitudinal direction of the developer bearing member, wherein a thickness of an escaped portion is smaller than a thickness of a contact portion so that at least a part of a region from the tip portion to the contact portion that is brought into contact with the developer bearing member escapes on a side opposite to the developer bearing member in the first region of the regulation portion, wherein a thickness of the region from the tip portion to the contact portion that is brought into contact with the developer bearing member is nearly the same in the second region of the regulation portion, and wherein the sealing member is brought into contact with only the second region of the regulation portion rather than the first region.

2. A developing device comprising:

a developer bearing member configured to bear a developer;

a developer regulating member configured to have a regulation portion comprised of an elastic member that is brought into contact with the developer bearing member, and a supporting portion that supports the regulation portion, wherein a longitudinal direction of the regulation portion is along a longitudinal direction of the developer bearing member, wherein the regulation portion has a base portion and a tip portion, wherein the base portion is an end portion on a side of a portion connected with the supporting portion in a transverse direction, and the base portion is opposite to the tip portion, wherein the tip portion is disposed on an upstream side in a moving direction of the developer bearing member, and wherein the developer regulating member regulates a developer borne by the developer bearing member; and a sealing member configured to be brought into contact with a surface of the regulation portion, wherein the surface is on an opposite side of the regulation portion to the developer bearing member, wherein the regulation portion has a first region and a second region, wherein the second region is adjacent to the first region on a side of an end portion in the longitudinal direction of the regulation portion, and the second region is disposed outside a region corresponding to an image forming region on an image bearing member on which an electrostatic image to be developed by the developing device is formed, in a longitudinal direction of the developer bearing member, wherein a thickness of an escaped portion is smaller than a thickness of a contact portion so that at least a part of a region from the tip portion to the contact portion that is brought into contact with the developer bearing member escapes on a side opposite to the developer bearing member in the first region of the regulation portion, wherein the regulation portion brings the tip portion into contact with the developer bearing member in the second region, and wherein the sealing member is brought into contact with only the second region of the regulation portion rather than the first region.

3. The developing device according to claim 1, wherein the regulation portion is brought into contact with the developer bearing member at a boundary between a portion having a thickness of the contact portion and a portion having a thickness smaller than the thickness of the contact portion in the first region.

4. The developing device according to claim 1, wherein a thicknessh of a tapered portion of the region from the contact portion to the tip portion gradually decreases on the side of the tip portion in the first region of the regulation portion so that the region escapes on the side opposite to the developer bearing member, and wherein a thickness of a portion extending from the tapered portion to the tip portion is nearly the same.

5. The developing device according to claim 1, wherein the sealing member presses the regulation portion toward the developer bearing member.

6. A process cartridge comprising:

an electrophotographic photosensitive member; and a developing device according to claim 1, wherein the developing device is configured to develop an electrostatic image formed on the electrophotographic photosensitive member, and wherein the process cartridge is detachable from a device main body of an image forming device.

7. The process cartridge according to claim 6, wherein the regulation portion is brought into contact with the developer bearing member at a boundary between a portion having a thickness of the contact portion and a portion having a thickness smaller than the thickness of the contact portion in the first region.

8. The process cartridge according to claim 6, wherein a thickness of a tapered portion of the region from the contact portion to the tip portion gradually decreases on the side of the tip portion in the first region of the regulation portion so that the region escapes on the side opposite to the developer bearing member, and wherein a thickness of a portion extending from the tapered portion to the tip portion is nearly the same.

9. The process cartridge according to claim 6, wherein the sealing member presses the regulation portion toward the developer bearing member.

10. An image forming device comprising:

an image bearing member; and a developing device according to claim 1, wherein the developing device is configured to develop an electrostatic image formed on the image bearing member.

11. The image forming device according to claim 10, wherein the regulation portion is brought into contact with the developer bearing member at a boundary between a portion having a thickness of the contact portion and a portion having a thickness smaller than the thickness of the contact portion in the first region.

12. The image forming device according to claim 10, wherein a thickness of a tapered portion of the region from the contact portion to the tip portion gradually decreases on the side of the tip portion in the first region of the regulation portion so that the region escapes on the side opposite to the developer bearing member, and wherein a thickness of a portion extending from the tapered portion to the tip portion is nearly the same.

13. The image forming device according to claim 10, wherein the sealing member presses the regulation portion toward the developer bearing member.

* * * * *